US006098951A

United States Patent [19]

McFadden et al.

[11] Patent Number: 6,098,951

[45] Date of Patent: *Aug. 8, 2000

[54] UNIVERSAL MOUNTING BRACKET FOR FRENCH FRY PRESS

[76] Inventors: Michael John McFadden, 1309 Midmeadow Rd., Baltimore, Md. 21286-1606; John Culp McFadden, 8325 Tally Ho Rd., Lutherville, Md. 21093-4720

[ * ] Notice: This patent issued on a continued prosecution application filed under 37 CFR 1.53(d), and is subject to the twenty year patent term provisions of 35 U.S.C. 154(a)(2).

[21] Appl. No.: 09/063,543

[22] Filed: Apr. 21, 1998

Related U.S. Application Data

[60] Provisional application No. 60/044,487, Apr. 21, 1997.

[51] Int. Cl.[7] ..... B26D 3/26

[52] U.S. Cl. ..... 248/674; 248/309.1; 248/225.11; 83/932

[58] Field of Search ..... 248/309.1, 301, 248/304, 674, 675, 220.41, 220.42, 220.43, 225.21, 225.11; 83/932

[56] References Cited

U.S. PATENT DOCUMENTS

| | | | |
|---|---|---|---|
| 813,149 | 2/1906 | Harsch | 248/675 X |
| 2,209,653 | 7/1940 | Larsson | 248/674 |
| 2,488,903 | 11/1949 | Edwards | 248/222.51 X |
| 4,056,250 | 11/1977 | Uchiyama | 248/674 |
| 4,094,485 | 6/1978 | O'Callaghan | 248/309.1 X |
| 4,796,844 | 1/1989 | Barker | 248/304 X |
| 5,086,916 | 2/1992 | Gray | 248/225.21 X |
| 5,224,609 | 7/1993 | Bauer et al. | 248/220.41 X |

*Primary Examiner*—Ramon O. Ramirez
*Assistant Examiner*—Stephen S. Wentsler
*Attorney, Agent, or Firm*—Law Offices of Royal W. Craig

[57] ABSTRACT

An improved extended mounting bracket for a french fry press. The mounting bracket generally comprises a back plate with two opposing protruding side brackets. The side brackets are integrally attached along the opposing edges of the back plate by welding or the like. Both side brackets are formed with upper and lower notches adapted to slidably receive and anchor a conventional french fry press. The extended mounting bracket extends the french fry press over a proper waste receptacle such as a sink and thereby facilitates efficient waste disposal and cleanup. The bracket is rugged, durable, and it can be manufactured at nominal cost.

7 Claims, 4 Drawing Sheets

UNIVERSAL MOUNTING BRACKET FOR FRENCH FRY PRESS

CROSS-REFERENCE TO RELATED APPLICATIONS

The present application is based on provisional application Ser. No. 60/044,487, filed Apr. 21, 1997.

BACKGROUND OF THE INVENTION

1. Field of the Invention

The present invention relates to commercial kitchen accessories and, more particularly, to an extended mounting bracket for french fry presses which allows convenient mounting of a press over a proper receptacle, and which thereby facilitates efficient waste disposal and cleanup.

2. Description of the Background

Restaurants and commercial kitchens make use of industrial french fry presses for dicing potatoes and forming shoestring french fries therefrom. There are many commercially available french fry presses, and most typically include protruding upper and lower mounting arms that protrude rearwardly from a lever operated press. The press itself generally comprises a hand-operated lever pivotally attached between the upper mounting arms. A lower cutting plate is mounted between the lower mounting arms. In operation, a potato is situated atop the lower cutting plate. When urged downwardly, the lever drives a piston which is connected to an upper cutting plate slidably poesitioned above the lower cutting plate. The upper cutting plate is driven directly downward into the potato, and forces the potato against the lower cutting plate. The potato is driven through the lower cutting plate which shreds the potato into shoestring french fries. These french fry presses are usually mounted via the protruding upper and lower mounting arms to a wall fixture supplied with the unit. Unfortunately, these wall fixtures are adapted for flush attachment to the wall by wall anchors or the like. This compels mounting where there is ample wall-space, and there is little or no clearance from the wall. Consequently, the fry cutting operation inevitably results in quite a mess on whatever lies beneath. It would be greatly advantageous to provide an extended mounting bracket which may be universally used to mount a variety of fry cutting presses on any flat surface, and which is capable of extending the french fry press over a proper waste receptacle such as a sink. This would greatly facilitate efficient waste disposal and cleanup.

SUMMARY OF THE INVENTION

It is, therefore, an object of the present invention to provide a heavy duty extended mounting bracket which may be universally used to mount a variety of fry cutting presses on any flat surface, including walls, cabinets and/or refrigerators.

It is another object to provide a mounting bracket as described above which is capable of extending the french fry press over a proper waste receptacle such as a sink to facilitate efficient waste disposal and cleanup.

It is yet another object to provide a mounting bracket as described above which facilitates easy disengagement of the french fry press for removal and cleaning of the lower cutting blade.

It is another object to provide an extended mounting bracket with the above-described features, and which can be manufactured and installed at minimal cost.

In accordance with the above objects, an improved extended mounting bracket for a french fry press is described herein. The mounting bracket generally comprises a back plate with two opposing protruding side brackets. The side brackets are integrally attached along the opposing edges of the back plate by welding or the like. Both side brackets are formed with upper and lower notches adapted to slidably receive and anchor a conventional french fry press. The extended mounting bracket extends the french fry press over a proper waste receptacle such as a sink, and thereby facilitates efficient waste disposal and cleanup. The bracket is rugged, durable, and it can be manufactured at nominal cost.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DESCRIPTION OF THE PREFERRED EMBODIMENTS

Figure 1:
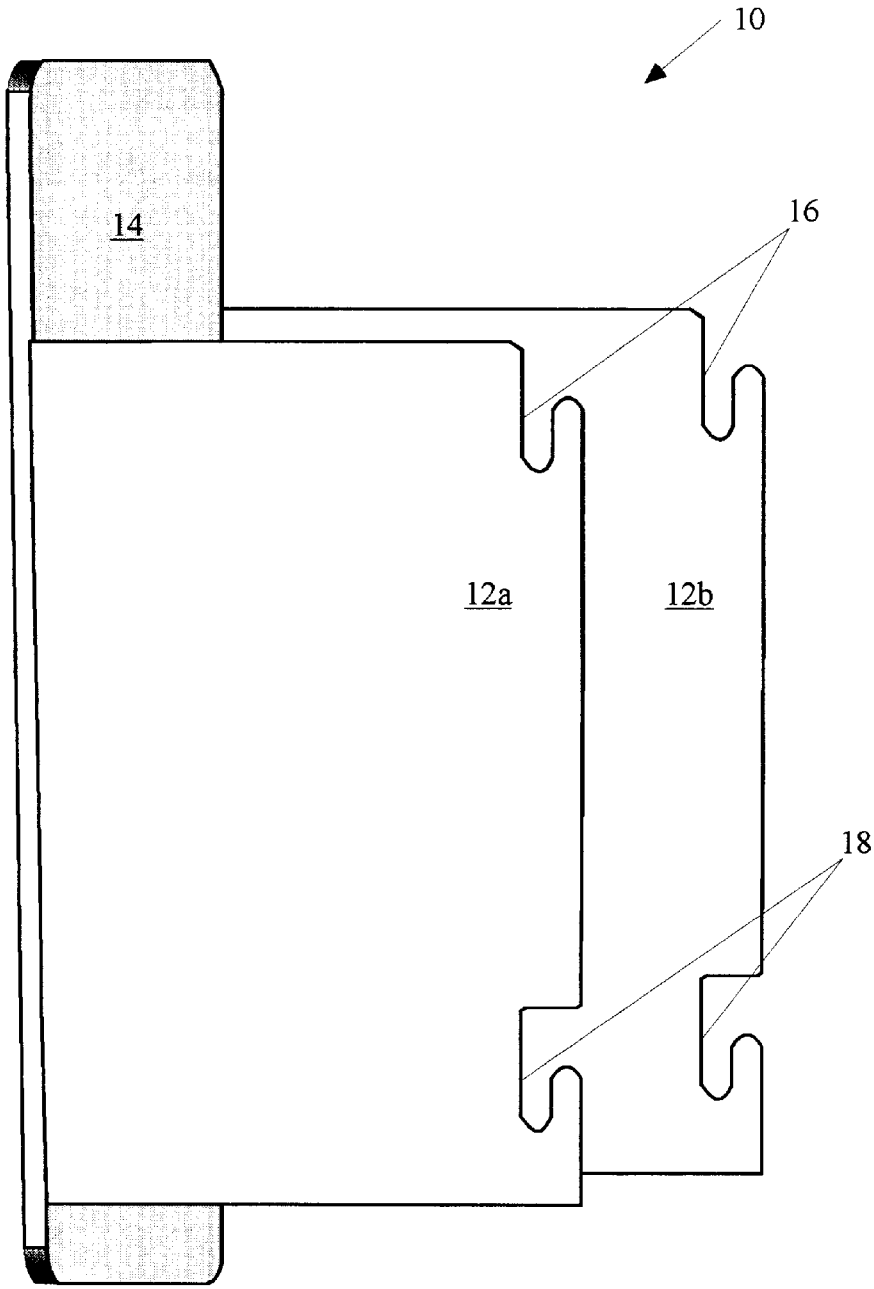
FIG. 1 is a side perspective view of the extended mounting bracket 10 for a french fry press according to the present invention.

FIG. 1 is a side perspective view of the extended mounting bracket 10 for a french fry press according to the present invention. The mounting bracket 10 generally comprises a back plate 14 with two opposing and frontally protruding side brackets 12*a* & 12*b*. The back plate 14 and both side brackets 12*a* & 12*b* are preferably machined from plates of rust-proof steel or aluminum, and a uniform plate thickness of ¼" provides suitable strength and rigidity. Side brackets 12*a* & 12*b* are integrally attached along the opposing edges of back plate 14, and this may be accomplished by welding or other suitable means. Both side brackets 12*a* & 12*b* are formed with upper and lower notches 16, 18, respectively. Upper and lower notches 16, 18 are adapted to slidably receive and anchor a conventional french fry press in a manner to be described.

Figure 2:
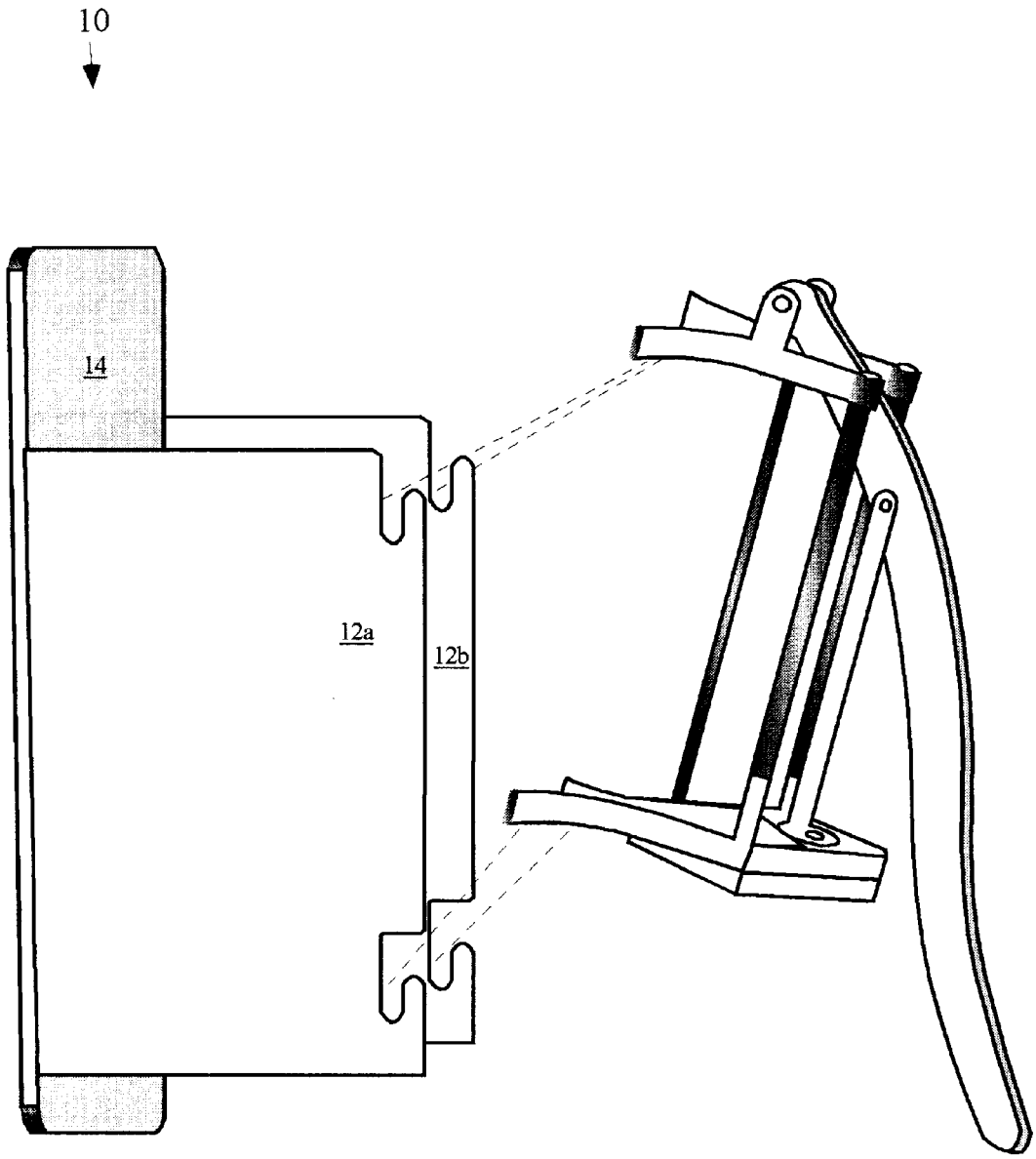
FIG. 2 is a side perspective view of the extended mounting bracket 10 of FIG. 1 pictured prior to insertion of a conventional french fry press.

FIG. 2 is a side perspective view of the extended mounting bracket 10 of FIG. 1 pictured prior to insertion of a conventional french fry press. This exemplifies one among a variety of commercially available french fry presses, all of which may readily be purchased from companies such as Vollratn and Halco. These and other typical french fry presses include protruding upper and lower mounting arms that protrude rearwardly from a lever operated press. The press itself generally comprises a hand-operated lever pivotally attached between the two upper mounting arms. A lower cutting plate is mounted between the lower mounting arms. In operation, a potato is situated atop the lower cutting plate. When urged downwardly, the lever drives a piston which is connected to an upper press plate that is guided for slidable movement between the upper and lower mounting arms. The upper press plate is driven directly downward into the potato, and thereby forces the potato against the lower cutting plate. The potato is driven through the lower cutting plate which shreds the potato into shoestring french fries.

Typically, the french fry press is mounted via the protruding upper and lower mounting arms to a wall fixture or the like. Commercially available french fry presses are often supplied with simple wall fixtures which are adapted for flush attachment to the wall by wall anchors or the like. This compels mounting where there is ample wall-space, and it affords little or no clearance from the wall. Subsequent fry-cutting operation can result in a substantial mess on whatever lies beneath.

In accordance with the present invention, the mounting bracket 10 affords much more flexibility in the manner and location of mounting. Mounting bracket 10 may be conveniently attached to any flat surface, including walls, cabinets and/or appliances. It can be mounted wherever necessary to insure that the french fry press is sufficiently extended over a proper waste receptacle such as the sink.

Figure 3:
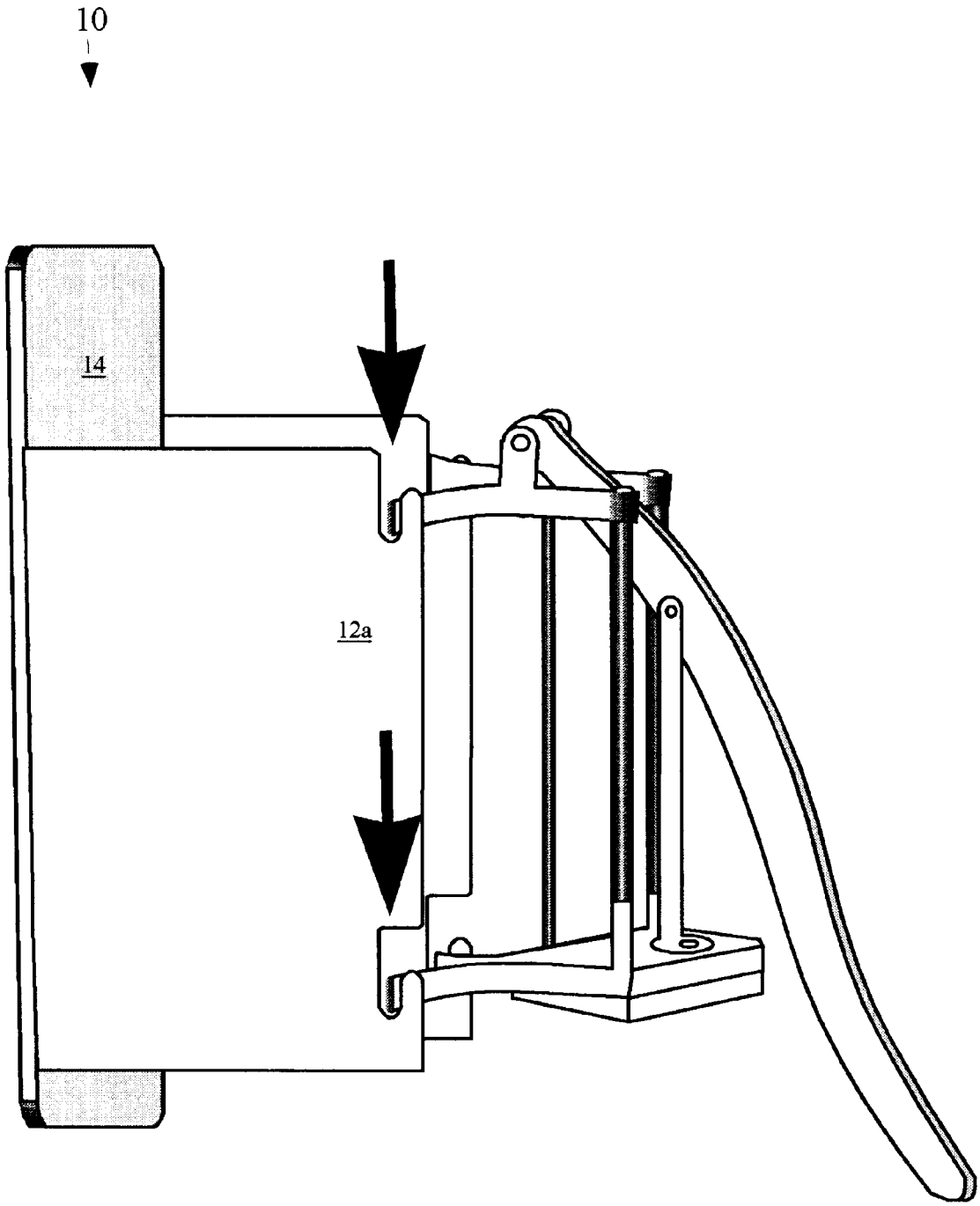
FIG. 3 is a side perspective view of the extended mounting bracket 10 of FIGS. 1 and 2 shown with a fully inserted french fry press.

FIG. 3 is a side perspective views of the extended mounting bracket 10 of FIGS. 1 and 2 shown with a fully inserted french fry press. The french fry press is rigidly secured by its protruding upper and lower mounting arms to mounting bracket 10, said arms being held captive within the upper and lower slots 16, 18 of the opposing side brackets 12*a*, 12*b*.

Figure 4:
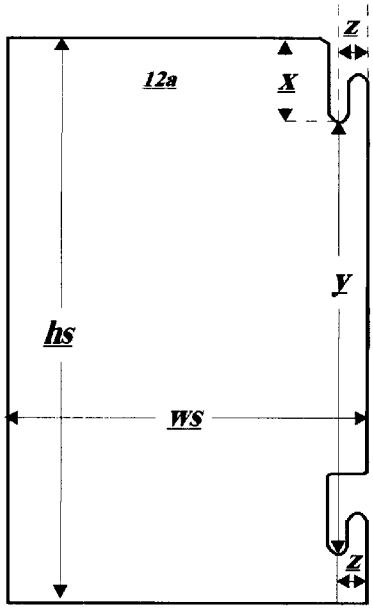
FIG. 4 is a frontal view of a side bracket 12*a* used in extended mounting bracket 10.

FIG. 4 is a frontal view of one of the two identical side brackets 12*a* used in conjunction with the extended mounting bracket 10. Both identical side brackets 12*a* & 12*b* are preferably machined from plates of rust-proof steel or aluminum, and a uniform plate thickness of ¼" provides suitable strength and rigidity. Both side brackets 12*a* & 12*b* are preferably formed in a substantially rectangular shape with rounded safety corners. The dimensions of the rectangle may vary somewhat depending on the amount of extension required. Prototypes have been constructed and suitable dimensions have been found to be on the order of 8 ½" width (ws), and 12 ⅞" height (hs). Both side brackets 12*a* & 12*b* are formed with upper and lower notches 16, 18, respectively. Upper notch 16 is formed to provide a vertical channel running directly downward the upper corner of the side brackets 12. Lower notch 18 is formed to provide a horizontal inlet which extends to a right-angled downwardly extending channel that is substantially collinear with said upper notch. The upper and lower notches 16, 18 are adapted to slidably receive and anchor a conventional french fry press in the above-described manner. A suitable dimension for both the upper notch 16 and lower notch 18 has been found to be on the order of a 2 ¼" depth (x). The upper notch 16 extends directly downward from the upper edge of side brackets 12*a* & 12*b*, the center of notch 16 being spaced approximately 1" inward (z) from the side of side brackets 12*a* & 12*b*. The lower notch 18 cuts in 1" (z) from the side of side brackets 12*a* & 12*b*, and extends downward colinear with upper notch 16. The upper notch 16 and lower notch 18 are vertically spaced approximately 9 ¾" (y) from each other.

Figure 5:
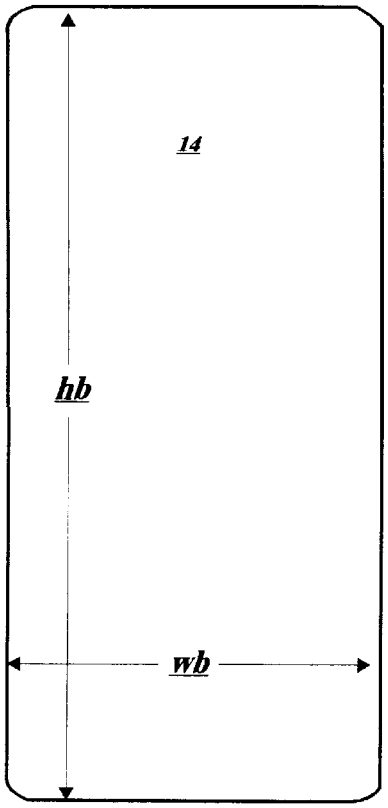
FIG. 5 is a frontal view of back plate 14 used in extended mounting bracket 10.

FIG. 5 is a frontal view of back plate 14 used in extended mounting bracket 10. The back plate 14 is preferably formed in a substantially rectangular shape with rounded safety edges. The dimensions of the rectangle may vary somewhat depending on the dimensions of the side panels 12*a* & 12*b*. However, given the above-described side-panels, suitable dimensions for the back plate 14 have been found to be on the order of 8" width (wb), and 22 ⅜" height (hb).

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth herein.

I claim:

1. A commercial french fry cutting press and a universal mounting bracket therefore, comprising:

a mounting bracket, said mounting bracket further comprising:

a rigid, substantially rectangular planar back plate for face to face attachment to a vertical wall; and two identical, opposing, substantially rectangular side brackets having rounded corners, said side brackets being integrally attached to and frontally protruding from opposed edges of said back plate, said side brackets each being formed with upper and lower recesses; and a french fry press, said french fry press further comprising:

a pair of rearwardly protruding upper mounting arms, said upper mounting arms being removably seated within said upper recesses of said side brackets;

a pair of rearwardly protruding lower mounting arms, said lower mounting arms being removably seated within said lower recesses of said side brackets; and a vertical press assembly disposed between said upper and lower mounting arms, said vertical press assembly further comprising a cutting plate mounted between said lower mounting arms, a lever pivotally attached to said upper mounting arms, and a press plate operatively attached to said lever and guided for slidable movement between said upper and lower mounting arms; and whereby said mounting bracket is for maintaining said french fry press in a removable, vertical, wall-mounted position while providing sufficient clearance of the french fry press from a wall to allow the french fry press to extend over a waste receptacle.

2. The commercial french fry cutting press and universal mounting bracket of claim 1, said back plate having a width of approximately 8 inches and a height of approximately 22 ⅜ inches.

3. The commercial french fry cutting press and universal mounting bracket of claim 1, said upper recesses being located on a front edge of each of said side brackets adjacent a top edge of each of said side brackets, said upper recesses slidably receiving and anchoring the upper mounting arms of said french fry press; and said lower recesses being located on a front edge of each of said side brackets near a bottom edge of each of said side brackets, said lower recesses slidably receiving and anchoring the lower mounting arms of said french fry press.

4. The commercial french fry cutting press and universal mounting bracket of claim 3, wherein said lower recesses are colinear with said upper recesses on each of said side brackets.

5. The commercial french fry cutting press and universal mounting bracket of claim 4, wherein said lower recesses are spaced approximately 9 ¾ inches from said upper recesses on each of said side brackets.

6. The commercial french fry cutting press and universal mounting bracket of claim 4, wherein each of said side brackets has a width of approximately 8 ½ inches, and a height of approximately 12 ⅞ inches.

7. The commercial french fry cutting press and universal mounting bracket of claim 6, wherein each of said upper and lower recesses are provided with a recess depth of 2 ¼ inches, and are positioned 1 inch inward from said front edge of each of said side brackets.

* * * * *